US005480367A

United States Patent [19]

Bergman

[11] Patent Number: 5,480,367

[45] Date of Patent: Jan. 2, 1996

[54] ADDUCTOR/ABDUCTOR EXERCISE DEVICE

[75] Inventor: Alan Bergman, London, England

[73] Assignee: Sportsquip Limited, Dublin, Ireland

[21] Appl. No.: 140,774

[22] Filed: Oct. 21, 1993

Related U.S. Application Data

[63] Continuation-in-part of Ser. No. 979,445, Nov. 20, 1992, abandoned, which is a continuation of Ser. No. 854,743, Mar. 19, 1992, abandoned, which is a continuation of Ser. No. 474,015, filed as PCT/GB88/00900, Oct. 26, 1988, abandoned.

[30] Foreign Application Priority Data

Oct. 26, 1987 [GB] United Kingdom ..... 8725016
Nov. 12, 1987 [GB] United Kingdom ..... 8726552

[51] Int. Cl.[6] ..... A63B 21/055; A63B 23/04

[52] U.S. Cl. ..... 482/122; 482/126

[58] Field of Search ..... 482/92, 111–113, 482/121, 122, 124–128, 131

[56] References Cited

U.S. PATENT DOCUMENTS

| | | | |
|---|---|---|---|
| 1,956,498 | 4/1934 | Duke | 482/126 |
| 2,619,154 | 11/1952 | Erickson . | |
| 2,855,198 | 10/1958 | King . | |
| 2,994,365 | 8/1961 | Ziegler . | |
| 3,077,347 | 2/1963 | Nova . | |
| 3,174,343 | 3/1965 | Kasulis . | |
| 3,345,656 | 10/1967 | Steinman . | |
| 3,540,724 | 11/1970 | Hunter . | |
| 3,638,941 | 2/1972 | Kulkens . | |
| 3,756,597 | 9/1973 | Monti . | |
| 3,949,435 | 4/1976 | Dionne . | |
| 3,971,255 | 7/1976 | Varney et al. | 482/909 X |
| 3,981,030 | 9/1976 | Turner . | |
| 3,992,004 | 11/1976 | Feron . | |
| 4,111,417 | 9/1978 | Gardner . | |
| 4,167,938 | 9/1979 | Remih . | |
| 4,211,404 | 7/1980 | Blowsky . | |
| 4,235,437 | 11/1980 | Run . | |
| 4,406,453 | 8/1983 | Herzfeld | 482/126 |
| 4,461,472 | 7/1984 | Martinez . | |
| 4,466,610 | 8/1984 | Israel . | |
| 4,580,778 | 4/1986 | Van Noord | 482/121 X |
| 4,619,454 | 10/1986 | Walton . | |
| 4,623,145 | 11/1986 | Paraskevako . | |
| 4,625,960 | 12/1986 | Groich . | |
| 4,678,234 | 7/1987 | Wilson . | |
| 4,692,954 | 9/1987 | Scott . | |
| 4,826,158 | 5/1989 | Fields . | |

FOREIGN PATENT DOCUMENTS

| | | | |
|---|---|---|---|
| 646555 | 8/1962 | Canada . | |
| 1012574 | 6/1977 | Canada . | |
| 166342 | 7/1950 | European Pat. Off. | 482/121 |
| 2087415 | 12/1971 | France . | |
| 694008 | 7/1940 | Germany . | |
| 1011813 | 12/1965 | United Kingdom . | |
| 1394245 | 5/1975 | United Kingdom . | |

*Primary Examiner*—Richard J. Apley
*Assistant Examiner*—John Mulcahy
*Attorney, Agent, or Firm*—Ladas & Parry

[57] ABSTRACT

An exercise device for exercising the adductor and abductor muscles of the thigh portion of the legs without connecting the device to the legs in which a bar member is provided which can be placed below the thigh or above the knees to extend across the thighs or knees. Side members are provided to extend in the same direction down the inside or outside of the calf portion of the legs so that the device can then be used either for exercising in which the legs move outwardly or to be placed between the knees to provide resistance to inward movement of the thighs. In a preferred form of the invention the bar member is an elongate hollow member with a lid, with one side member permanently attached thereto and the other side member is movable back and forth from a rest position against a resistance force to exercise the adductor and abductor muscles without attachment of the device to the legs. There may be provided means for adjusting the spacing or tension between the end members which can be loaded so as to provide greater resistance as the device is moved inwardly or outwardly. The loading can be effected by a resilient band or spring.

24 Claims, 4 Drawing Sheets

ADDUCTOR/ABDUCTOR EXERCISE DEVICE

CROSS REFERENCE TO RELATED APPLICATIONS

This is a continuation-in-part of application Ser. No. 07/979,445, filed Nov. 20, 1992, now abandoned, which is a continuation of application Ser. No. 07/854,743, filed Mar. 19, 1992, now abandoned, which is a continuation of application Ser. No. 07/474,015, filed as PCT/GB88/00900, Oct. 26, 1988, now abandoned.

BACKGROUND OF THE INVENTION

1. Field of the Invention

This invention relates to an exercise device particularly for the muscles of the upper leg and lower abdomen.

2. Description of Prior Art

When exercising the legs and lower abdomen muscles it is necessary to provide an exercising device that will help to give the adductor and abductor muscles (tendons and ligaments) acting on the upper thigh, hip and buttocks (as well as the muscles of the lower abdominal area) increased strength and flexibility and thereby an improved toned shape as opposed to building an undesirable bulky muscle mass which usually occurs with the use of weighted plate machines. This more streamlined shape is particularly important to women who are concerned about the appearance of their thighs, hips and buttocks, and are desirous of slender firmer appearance. Furthermore and more importantly, this exercise device can be used for the rehabilitation of people recovering from hip traumas and particularly pre- and post-hip operative conditions.

Research into the applied anatomical interaction of muscles (tendons and ligaments) shows that for the purpose of producing increased strength (resulting in toning and firming) a muscle must ideally be acting against positive and negative resistance through, as much as possible, its full range of possible movement. This concept of positive and negative resistance is utilized in this invention to produce increased strength along with improved flexibility which is a most important by-product of this invention.

There are various forms of exercise devices now available for different parts of the human body. There are less desirable devices which are rigid and which merely provide a means for resisting muscular movement. However, generally such devices involve springs or plates weighted to various levels of resistance in which pressure is applied at both ends or at one end of the device, either inwardly or outwardly, vertically upwards or downwards. The effort of overcoming the spring or weight-loaded resistance provides the necessary tension to strengthen the muscles of the arms, shoulders, chest, back, abdomen, the flexors and extensors of the legs and the calves. Most of these devices primarily operate by having pressure applied by the muscles, through the hands. In the case of leg machines pressure is applied through the feet and ankles. In both instances the force of exertion is along the central axis of the body of the device, depending upon the nature of the resilient means. The spring or weighted plates can be mounted outside that axis, for example in machines with semi-circular springs as well as in many types of weights lifted via pulley systems (as in training machines having pulleys with positive and negative cam assisted weights).

With the exception of exercising devices which are freely hand held and are particularly appropriate for exercising the muscles of the arms, chest, shoulders and back, since it is relatively easy to grasp one or both ends with the hands, most exercising devices are usually large, bulky and very heavy machines which are very expensive.

SUMMARY OF THE INVENTION

Accordingly, it is desirable to provide a light weight portable exercise device particularly for exercising the adductor and abductor muscles of the thigh as well as muscles of the lower abdomen.

According to the present invention there is provided a strapless exercise device adapted for exercising the adductor and abductor muscles of a person's legs comprising an elongate hollow bar member defining an elongate slot in an undersurface thereof, and two side members extending freely from the bar member in the same direction substantially at right angles to the bar member to form an open U-shaped space whose ends are formed by said side members and whose base is formed by said undersurface of the bar member, said side members being joined to said bar member at the base of the U-shaped space with one side member fixable relative to the bar member and the other when attached being movable along the elongate slot in the base of the bar member in either direction against force resistance means inside the bar member, the side members including inner and outer surfaces thereof for respectively engaging outer and inner surfaces of the person's knees and upper calf portions of the legs, said side members being short relative to the longitudinal axis of the bar member but sufficiently long to allow the knee or upper calf portions of the legs to be firmly located against the side members inwardly or outwardly of the exercise device without securement of the device to the person's legs and to allow immediate removal of the device from the person's legs, and resilient means for resisting movement of said movable side member towards and away from the fixed side member for maintaining the person's legs in contact with the side members to exercise the adductor and abductor muscles in response to inward and outward movement of the person's legs.

The exercise device of this invention employs a blend of isotonic, isometric and isokinetic principles in various forms and degrees and provide, as described in detail below, in a most basic and unique way, an opportunity for the adductors and abductors of the thigh (femur) to be strengthened, resulting in an improved toned and firmed appearance, by positive and negative resistance. With the preferred exercise device utilizing a spring or other resilient means, positive resistance is produced when the adductors Longus, Magnus, Brevis, Gracilis and Pectinius are employed in bringing the thighs against a resistance force. Negative, adduction, resistance occurs when controlling the return to the starting position after having achieved a partial or complete thighs together position. In abducting or separating the thighs the muscles Glutius Medius, Minimus and Periformis are employed in positive muscle resistant functions.

This antagonistic effect of the adductors to the abductors and vice versa is responsible to a very large degree for smoothness in walking and strengthening of these muscles is therefore one of the most important functions of this invention. If these muscles are weak or impaired the gait is markedly affected. Bending or standing while on one leg would be most difficult or impossible without further support.

Of equal importance the exercise device of the present invention, whilst increasing strength, toning and firming of the adductor and abductor muscles to develop the same, also increases the flexibility of those muscles at the hip joint thereby improving the tone and strength of the muscles in the upper legs and around the hip joints thus rendering the invention particularly suitable for the medical application of hip rehabilitation.

Therefore, the present invention provides an exercise device for the muscles of adduction and abduction of the thigh (femur) and in particular its mobile relationship to the hip and particularly the hip joint (the ball and socket cavity). Additionally, and to a lesser degree, the muscles and ligaments of the lower Rectus Abdominus will be toned and firmed as a result of their consequential contraction and release in the effort exerted in the course of the use of the exercise device.

In one form of the invention a portion of each end member could be curved slightly inwardly so as to encompass the side of the legs. For example, the inner side of the member could be curved so as to encompass the outer portion of the leg while the outer portion could be either straight or curved in the other direction for use of the device between the legs.

In the simplest form of the exercise device the device consists of a cross-bar with two dependent rigid side members which could have upholstered cushion portions on those parts which would bear against the legs so as to make the device more comfortable in use. The device could then be placed between the legs so as to provide a resistance for the legs when moved together or alternatively the legs could be placed relatively close to each other, the device placed downwards over the legs or upwards under the legs and then the legs could bear on the side members when moved apart. The cushion covers on the exercise device could be polymeric pads and the upholstered coverings could be made of material such as cotton or Lycra/nylon or cotton/Lycra which can be removed for cleaning, as well as vinyl wipe off coverings of a more permanent nature. As already mentioned the side members can be configured so as to fit about or into the curve of the leg as appropriate to assist both in comfort and in providing greater gripping of the leg against the device when in use. The side members could be hinged to the main cross member so as to permit folding away after use although for application to inward movement of the leg exercises the side members would have to be lockable in position.

The device can be formed as to be adjustable either for assistance in the exercises or for the individual. For example, the cross member could be in two portions, one sliding within the other, a locking means being provided to lock the one part of the cross member in a fixed relationship to the other. This could be done by integral locking devices or by pins being slipped through holes in the two respective portions of the cross member.

In another and preferred embodiment of the invention the cross member can again be in two portions, the movement of the two portions being resisted by a spring or other resilient means against either inward or outward or both movements of the two end members. For example the cross member could be a tube with a spring located at one end, the other portion of the cross member being movable within the tube and bearing on the spring or being locked to the end of the spring so that the spring resists movement of the two portions of the cross member away from each other. In such a device again locking means can be provided to limit the degree of movement of the two portions of the cross member in respect to each other.

Such a device could be provided with various means of recording the degree of movement. The recording means can either be a simple mechanical pointer or could be a microelectronic device which measure the movement either in terms of distance or in terms of exercise potential e.g. resistance employed. The device could be provided with a memory of previous operations so that the increasing strength of the muscles being exercised could be measured and recorded.

For example, there could be provided groups of springs of different resistance to extensibility/compression or a single spring with adjustment means and the spring or springs or other tensioning means can be adjusted to vary the resistance of the exercise device. Such a device could be provided with an appropriate conventional digital readout in liquid crystal or similar form.

BRIEF DESCRIPTION OF THE DRAWINGS

The invention will now be described with reference to the accompanying drawings in which.

DESCRIPTION OF PREFERRED EMBODIMENT

Figure 1:
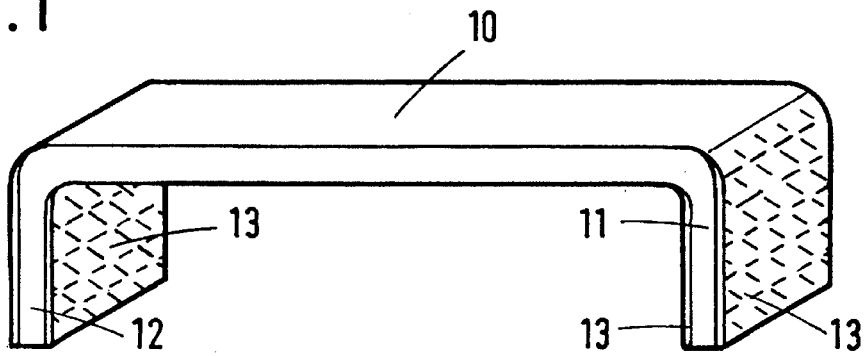
FIG. 1 illustrates a simple static exercise device according to the present invention.
Figure 2:
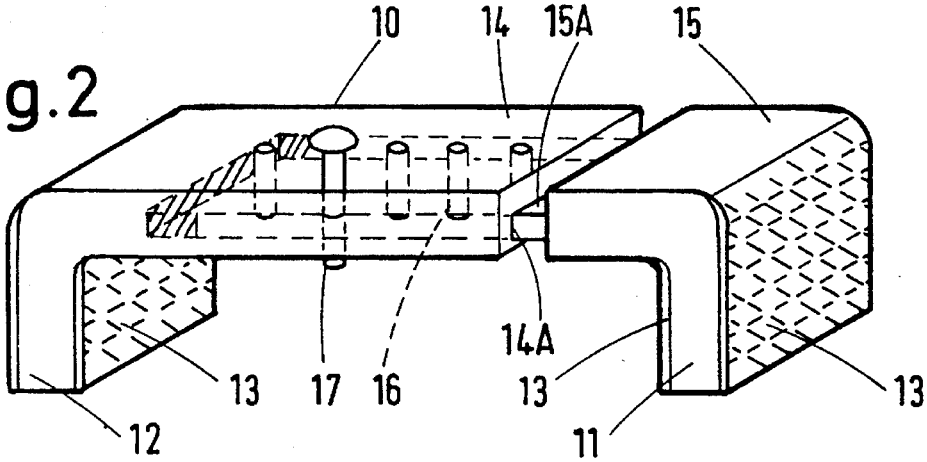
FIG. 2 shows a cross section of an adjustable exercise device according to the present invention.
Figure 3:
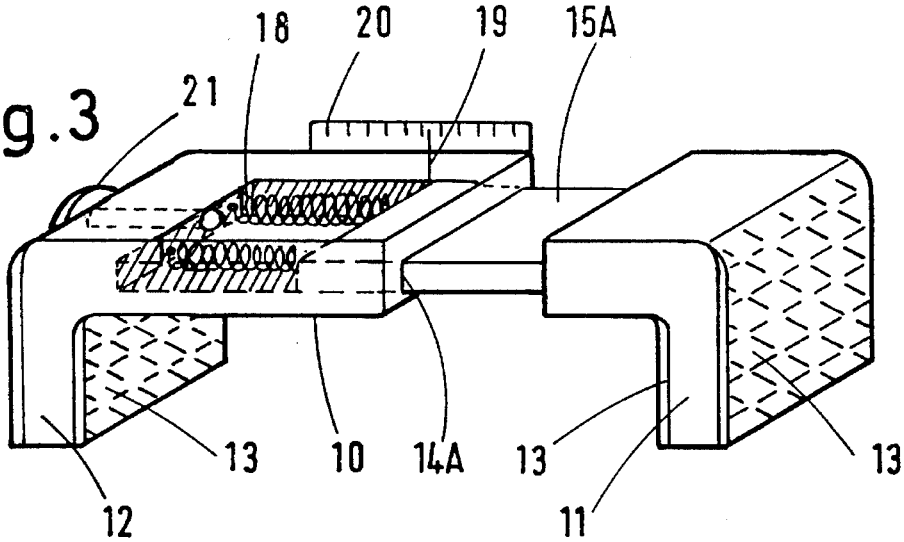
FIG. 3 shows the cross section of a spring loaded exercise device according to the present invention.

In each device shown in FIGS. 1 to 3 there is provided a cross member 10 and two side or end members 11 and 12 both extending downwardly in the drawings substantially at right angles to the cross members. In FIG. 1 the cross members and the side members are of a fixed one piece integral structure. Cushioning can be provided either on the inside or the outside or both sides on the end members and on appropriate portions of the cross member as shown at 13.

In FIG. 2 the cross member comprises two portions 14 and 15, the first portion having a channel 14A therein in which a narrow extension 15A of the second portion is arranged to slide. Matching holes 16 are provided in the two portions through which a pin 17 can be inserted to lock one portion in relation to the other.

In FIG. 3, as in FIG. 2, one portion is provided for the cross member which is a channel or tube within which the other side portion slides. Conveniently springs 18 are provided in one member 10 and attached to the end of the other portion as shown in FIG. 3. A mechanical pointer 19 is provided to move along a scale 20 fixed on the cross member 10 to provide an indication of the movement of pressure applied but this could be replaced by an electronic reading means in which either the force is read directly or by the movement of member and converted into a readout in a conventional digital readout device.

The exercising device in any of the forms illustrated is used by placing the device either between the users legs so that the inner portions of the legs bear against the outer sides of the end members; or by placing the cross member across the upper thighs with the thigh, knee or other parts of the leg bearing on the inside portions of the two end members or alternatively by placing the cross member underneath the legs so that the end members point upwardly and engage against the thighs, knees or other parts of the legs. Movement of the leg inwardly (adduction) or outwardly (abduction) as the case may be exercises the muscles Longus, Magnus, Brevis, Gracilis, Pectinius and Glutius Medius, Minimus and Periformis respectively and to a lesser extent the lower Rectus Abdominus. By alternating the location of the device from between the legs to the outside of the legs as well as controlling the power of the resilient means, the exercises can be alternated. The device can be located at different positions along the leg.

Whilst the exercise device has been described as having two springs 18, one or more springs can be utilized. The spring or springs 18 can be replaced by other resistance production devices, such as pneumatic devices. In either event an adjustment device can be provided to adjust the resistant force of the exercise device as indicated by adjustment knob 21 in FIG. 3.

Conveniently, the side members can be hingedly connected with the cross member for folding up against the cross member when not in use. A locking mechanism is preferably provided to lock the end members in their operative position.

FIGS. 4 to 7 disclose a preferred embodiment of an exercise device in accordance with the present invention and in the following description like parts to those shown in FIGS. 1, 2 and 3 bear the same reference numerals. The exercise device of FIGS. 4 to 7 comprises a flat elongate rectangular hollow box like structure which represents the cross bar member 10 and from which two side members 11, 12 extend outwardly of the bar in the same direction. The bar member 10 consists of two parts, the first of which is an open hollow box member 30 and the second a closing lid 31 for the box member 30.

Figure 4:
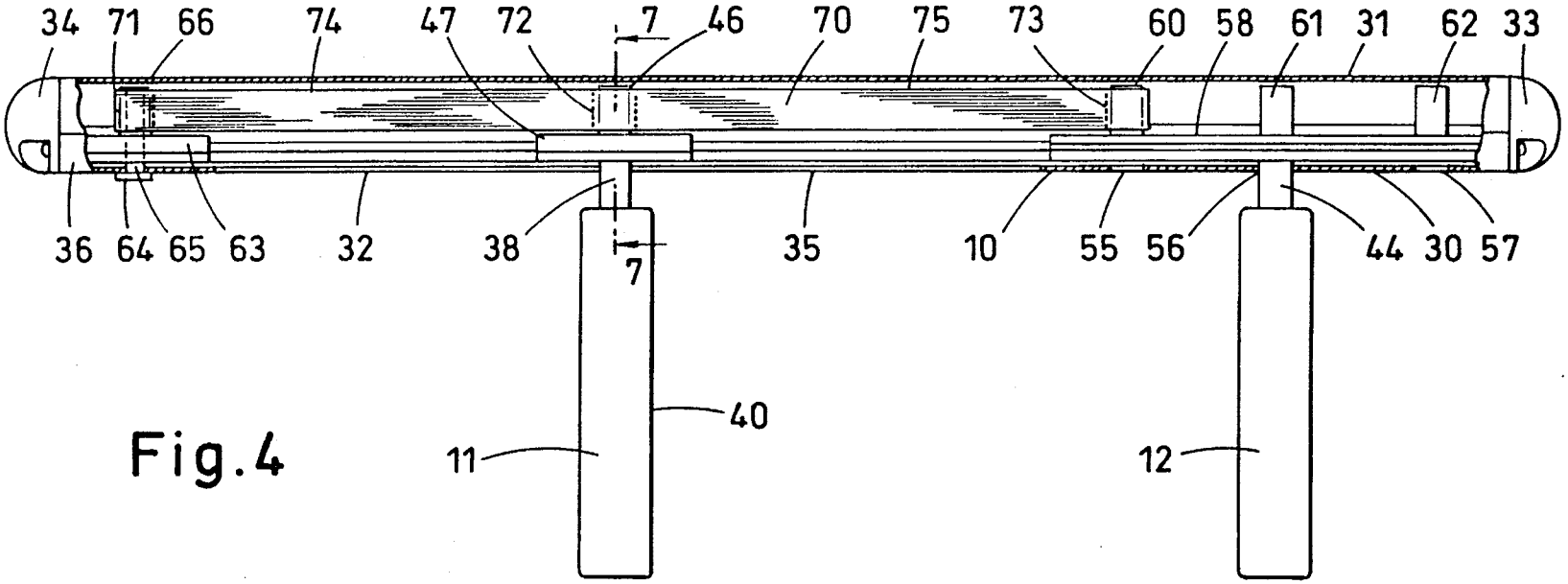
FIG. 4 is a part sectional side elevational view of an alternative embodiment of an exercise device in accordance with the present invention.

The side member 12 is screw threadedly fixed relative to bottom 32 of the bar member 10 inwardly of right hand end 33 of the bar member. Side member 11 shown in its "rest" position in FIG. 4 is located inwardly of the left hand end 34 of the bar member 10.

Figure 5:
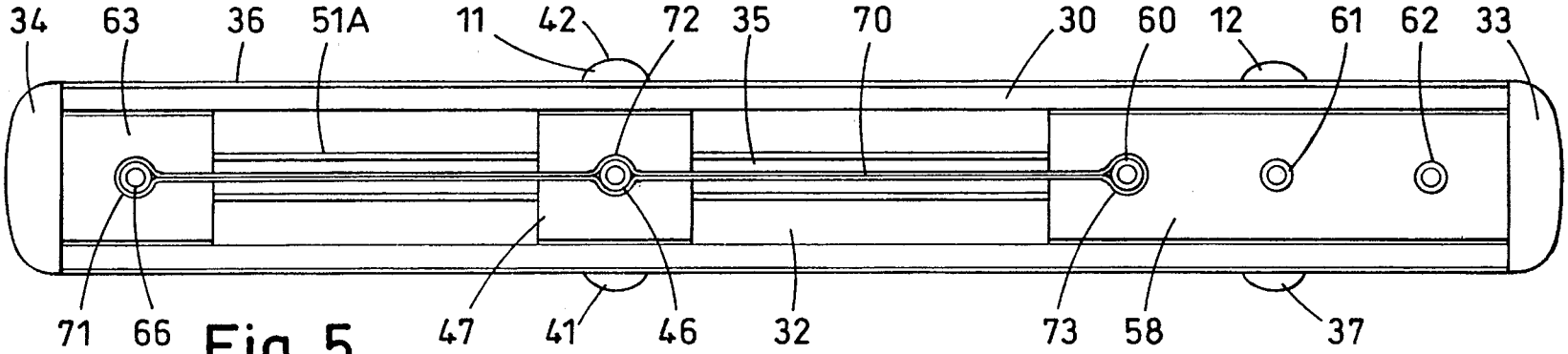
FIG. 5 is a top view of the device of FIG. 4 with a lid removed.
Figure 6:
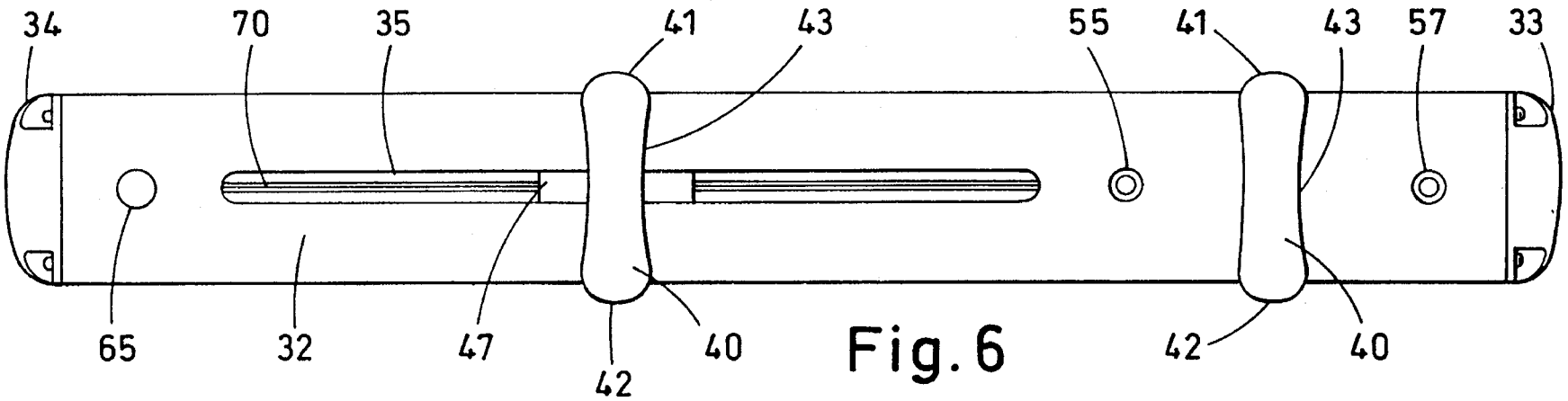
FIG. 6 is a bottom view of the device of FIG. 4.
Figure 7:
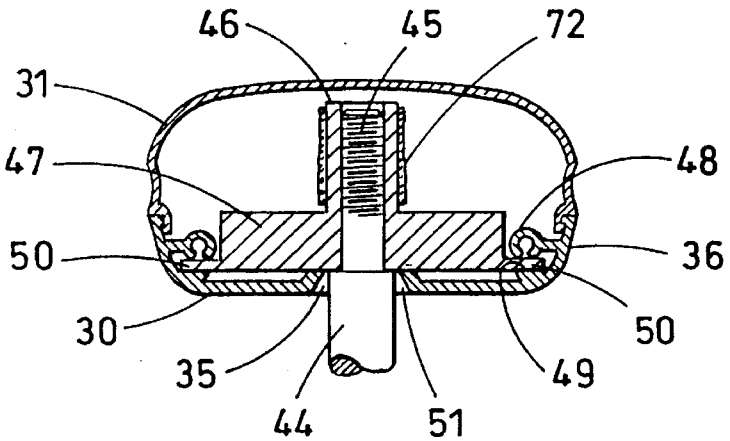
FIG. 7 is a part sectional view along the line 7—7 in FIG. 4.

A slot 35 through bottom 32 of the bar member 10 extends longitudinally thereof parallel with elongate sides 36. The side member 11 is not fixed relative to the bottom member 32 but is arranged to slide longitudinally along the slot 35. The side members 11 and 12 are both detachable from the bar member 10 for storing, packing and shipping the exercise device utilizing the minimum of space. The side members each comprise a pre-moulded generally flattish elongate rectangular pad 40 which extends transversely to the longitudinal axis of the bar member 10 with its rounded ends 41, 42 extending outwardly of the sides of the bar member as shown in FIG. 5. As illustrated in FIG. 6 side faces 43 of the side members are curved inwardly towards their centre so as to conform to the part of the leg extending below the knee when the exercise device is located across the knees. Each side member is moulded around a cylindrical rod 44 having a screw thread 45 at its free end. The side member 11 may be constructed in any conventional manner so as to prevent its removal from the bar member 10 in a transverse direction thereof.

The threaded portion 45 of rod 44 of side members 11, 12 is a reduced diameter portion relative to the remainder of rod 44. In the case of the side member 11 the threaded portion 45 engages the internal thread of an annular boss 46 outwardly extending from a rectangular block 47 slidably mounted in a track formed by an inwardly extending lug 48 from base portion 30 and a slide surface 49 extending from the inner wall of the bottom of the side member 10. The slidable block 47 has oppositely directed flanges 50 extending, respectively, one along each of two opposite sides of the block 47 and are locatable between lug 48 and slide surface 49.

The slot 35 is sufficiently wide to receive therethrough the larger diameter portion of the rod 44 whose end face at the point of reduction of diameter engages the face of block 47 remote from that from which the boss 46 extends, to provide a tight fit of the rod 44 relative to block 47. The slot 35 conveniently has its inner longitudinal edges turned inwardly at 51 with their transverse end faces forming a support for the centre of the block 47 in line with slide surfaces 49.

The connection of side member 12 is made in a substantially identical manner, however, the rod 44 projects through one of three apertures 55, 56 and 57 in the bottom 32 to engage a fixable block 58 having outstanding bosses 60, 61 and 62 corresponding to apertures 55, 56 and 57 respectively. The block 58 can be movable along the track defined by lug 48 and slide surface 49 on its own flanges 50 in the same manner as block 47 although is locked in position once side member 12 is engaged with one of the bosses 60, 61, 62 through one of the apertures 55, 56, 57.

A block 63 is constructed in the same manner as block 47 but is fixed in position at end 34 of cross bar 10 by a pin 64 passing through an aperture 65 in bar 10 and being screw threadedly engaged in boss 66.

In use the stiffness and resilience against movement of the side member 11 is effected by resilient band 70 which is attached to bosses 66, 46 and 60 of blocks 63, 47 and 58 respectively.

The band 70 is of a height substantially similar to the height of the bosses and is formed with loops 71, 72, 73 which are located over respective bosses 66, 46 and 60 and which divide the band into two portions 74, 75, one either side of boss 46.

In operation of the device shown in FIGS. 4 and 5 the exercise device is placed over the knees with the knees of an operator placed in the U-shaped space defined between the side members 11, 12 and the bar 10 with the concave centre portion 43 extending down the outside of the leg below the knee. An outward pressure is applied to the side members 11 and 12 by respective knees of the operator causes outward movement of side member 11 relative to side member 12 against the resilient force of band 70. The side member 12 of course does not move, but the side member 11 moves against tensional forces within the band 70 as the band begins to stretch between boss 46 and fixed boss 60. The further the side member moves to the left in FIGS. 4 and 5 the greater the force is required to overcome the resilience within the band portion 75, the band portion 74 exerting no force. When the legs of the operator are located externally of the side members 11 and 12, that is, in the space between each side member and the respective end 33, 34 of the bar 10, the legs are then brought towards one another and the inner parts of the knees and legs below the knees push against the outer surface of each side member whereupon again the side member 12 remains fixed and the side member 11 moves inwardly against tensional forces within the band portion 74, the band portion 75 exerting no force. Again the further inwardly the side member 11 moves the greater the force exerted by the band portion 74.

Conveniently, the resilient band 70 is easily detachable from the bosses by pulling them off the bosses and pushing the loops of a new band over the respective bosses. Accordingly, the tension in the exercise device can be altered by changing from a band which provides one maximum tension to another band providing an increased maximum tension or vice versa. In this manner an operator can increase his exercising ability in gradual stages by purchasing a number of bands at different tension grades.

The fixed side member 12 which is shown attached to boss 61 can also be fixed by personal selection to either of the bosses 60 or 62 to accommodate thin legs as well as thicker legs as the case may be. Also this varying of position of the side member 12 relative to the boss 60, 61 and 62 decreases or increases the angle of movement of the legs and thereby the difficulty of the exercise.

In either of the above mentioned operations when the operator is finished exercising the exercise device can be lifted immediately from the legs of the operator without any obstruction, there being no attachment of the side members to the legs of the operator. Furthermore, in the latter of the two operations the overlap of the member 10 outwardly of the side members 11, 12 ensures that when the operator has completed his exercise and he stops pressing against the side members the exercise device rests upon the legs of the operator and cannot fall between the legs to the ground.

The side member 12 which is fixed to the bottom 32 of the member 10 is shown in FIGS. 4 and 5 to be attached to the bottom 32 by a fixed block 58. However, the .side member 12 may be attached relative to the bar 10 by a push and snap lock fit in place of screw threaded portion 45 or any other conventional clamping technique.

In one alternative form the side member 12 may be in two parts with one part permanently attached relative to the bottom 32 and the side member 12 is detachable or pivotally attached to, the permanent fixture portion mounted on the bottom 32 of bar 10. In either event, during use of the exercise device the side member 12 is permanently fixed or locked as previously described relative to the side member 10 in its outwardly extended condition shown in FIG. 4. The side member 11 may similarly be in two separable parts for storage or have the main body of the side member pivotable relative to the movable portion thereof located inside the bar member 10.

Whilst the resilient band has been mounted as indicated in FIGS. 4 to 6, other mounting arrangements can be used provided tensional forces are provided against movement of the side member 11 in one or the other of its two opposite longitudinal directions of movement. For example the band 70 could be replaced by coil springs or other spring-like devices.

Whilst the side members in FIGS. 4 to 6 have been described as having pre-moulded cushion members moulded on either side thereof to the shape of the leg thus obviating the need for cushions, the side members may be made as indicated in FIGS. 1 to 3 to which separate cushions may be applied. The cross member of the exercise device of this embodiment is conveniently of an injection moulded plastics material while the side members are of a foamed plastics or rubber material, other suitable materials such as metal or wood can be used for both the cross and side members. The side members can be pivotally mounted with a locking device of a known type to lock the arms in their extended condition and released to allow the arms to pivot against the bar member for storage.

The embodiment described with reference to FIGS. 4 to 7 has been disclosed in the manner shown for simplicity but could include mechanical or electronic means which are well known in themselves for monitoring and displaying digitally the forces against which the exercises are being conducted, or the relative movement between the side members. The side members and bar member are preferably of a smooth plastics material.

Whilst the resilient band 70 has been described as being replaceable to increase or decrease the resilient forces applicable to the movable side member by changing the grade of belt to be used, the resilient forces with one particular band can be adjusted by detaching the band from annular boss 60 and attaching it to boss 61 or 62. The band 70 then becomes stretched increasing the resilient forces on the movable side member.

In an alternative embodiment of an exercise device according to the present invention the whole internal mechanism of the bar member other than apertures 55,56,57 and 65, and the slot 32 are mounted on the lid portion of the bar member and operate in the same manner as described for the embodiment of FIGS. 4 to 7. However, the side members 11,12 project through their respective slot 32 or aperture 56 to engage bosses 46,61 for example which in this instance project from their respective blocks on the lid portion towards the base of the bar member.

Figure 8:
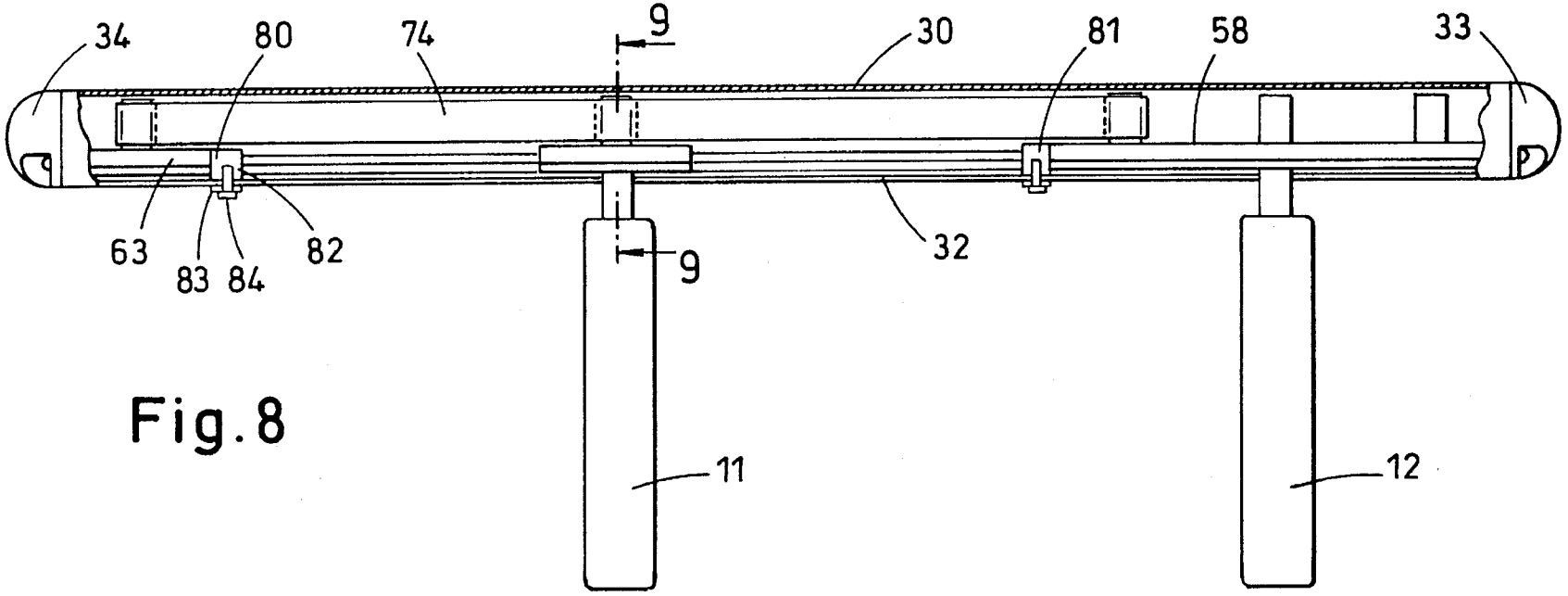
FIG. 8 is a part sectional side elevational view of a further alternative embodiment of an exercise device in accordance with the present invention.
Figure 9:
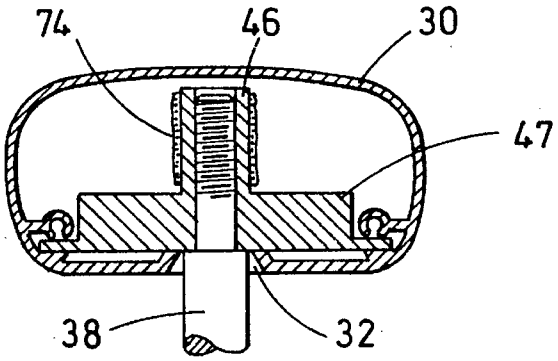
FIG. 9 is a part sectional view along the line 9—9 in FIG. 8.

A further alternative embodiment, shown in FIGS. 8 and 9 with like parts therein having the same reference numerals as the embodiment of FIGS. 4 to 7, may comprise an elongate hollow tube 30 of generally oval cross-section which has an elongate slot 32 extending the whole of the length of the tube in the longitudinal direction thereof. A stop 33 is located at one end of the tube and the internal mechanism previously described relative to FIGS. 4 to 7 is pre-assembled with or without the side members 11, 12 and slid along the slot until fully inserted into the tube. The remaining open end of the tube is then closed by further end stop 34. Additional locking devices 80, 81 are provided to ensure that once in place in the tubular cross member the blocks 58 and 63 are held rigidly in a fixed position against the end stop. The locking device 80,81 consists of two clamping plates 82,83 one inside and outside the tube with a clamping screw 84 extending therebetween through the slot 32. Clamping of respective plates against blocks 58, 63 by the screw locks the blocks between the plates and end stop members. The internal mechanism is then free to operate in the same manner as described with reference to FIGS. 4 to 7. To change the resilient belt 70 the locking devices 80, 81 are released, one end stop removed, and the mechanism slid out of the tube. When a new belt is attached the mechanism is re-assembled as described above.

In a further embodiment the hollow tube type arrangement just described can be a sealed unit so that once assembled the resilient band remains permanently attached to its respective bosses.

The embodiments described herein are disclosed as having an internal screw thread in each boss 46, 60, 61 and 62 with rods 38, 45, respectively, for ease of attachment or removal of the side members. However, such attachment may be effected by the well known standard push fit/pull release interconnection which has a "click/clack" operation.

This is achieved by one or more internally extending annular ribs on the bosses and an outwardly extending annular rib on side member rod portions 38, 44 which are forced passed the ribs to interlock these parts or to release them.

I claim:

1. A strapless exercise device adapted for exercising the adductor and abductor muscles of a person's legs comprising an elongate hollow bar member defining an elongate slot in an under surface thereof; two side members extending freely from said bar member in the same direction substantially at right angles to said bar member to define an open U-shape space therebetween, means for fixing one of said side members relative to said bar member and said other side member, when attached, being movable in either longitudinal direction relative to said bar member along said elongate slot, said side members including inner and outer leg contactable surfaces and being short relative to the longitudinal axis of said bar member but sufficiently long to be firmly located against said legs, and resilient force resistive means mounted inside said hollow bar member to resist movement of said movable side member toward and away from said fixed side member; whereby the said exercise device is locatable over a person's legs so that said side members engage respectively outer and inner surfaces of the person's knees and upper calf portions of the legs without securement of the device to the person's legs to allow immediate removal of the device from the person's legs, and whereby said force resistive means is effective to maintain said person's legs in contact with said side members to exercise the adductor and abductor muscles in response to inward and outward movement of the person's legs respectively.

2. An exercise device according to claim 1, wherein said bar member has a flat undersurface so that said bar member is capable of resting on the person's legs when the knee or upper calf portions of the legs are fitted in said U-shaped space between said side members.

3. An exercise device according to claim 2, wherein said side members are wider than the width of said bar member.

4. An exercise device according to claim 3, wherein said side members and said bar member are made of plastic material having a smooth surface finish.

5. An exercise device according to claim 1, wherein said side members have connector means by which said side members are joined to said bar member.

6. An exercise device according to claim 5, wherein said connector means for each side member comprises a rod extending from the side member.

7. An exercise device according to claim 6, wherein each rod has a screw threaded connection at a free end thereof for interconnection relative to said bar member.

8. An exercise device according to claim 6, wherein each said rod has a click/clack connection at a free end thereof for interconnection relative to said bar member.

9. An exercise device according to claim 1, wherein said side members each comprise plastic cushioning means.

10. An exercise device according to claim 1, wherein said side members each comprise rubber cushion means.

11. An exercise device according to claim 1, comprising indication means for indicating relative movement of said side members from a reference position.

12. An exercise device according to claim 1, wherein said resilient force resistive means is concealed inside said bar member.

13. An exercise device according to claim 1, wherein the resilient force resistive means comprises an elasticated band.

14. An exercise device according to claim 1, wherein said side members are located naturally inwardly of the opposed ends of said bar member.

15. An exercise device according to claim 1, wherein said bar member has a plurality of apertures therein through which said fixed side member is mounted on said bar member, the spacing between said side members in the natural state being thereby selectable to accord with the size of an operator's legs.

16. An exercise device as claimed in claim 1, wherein said bar member is a hollow tubular element and said slot therein extends substantially the length of said undersurface of said tube.

17. A strapless exercise device adapted for simultaneously exercising with a positive and negative resistance the adductor and abductor muscles of a person's legs comprising an elongate hollow bar member defining an elongate slot in an undersurface thereof, said hollow bar member including a hollow base portion and a lid portion for covering said base portion; two side members extending freely from said bar member in the same direction substantially at right angles to said bar member with one of said side members being movable relative to the other, said side members including internal and external leg contactable surfaces and being short relative to the longitudinal axis of said bar member but sufficiently long to be firmly located against said legs; and an elastic band located internally of said bar member being fixed at each outer end relative to said bar member, an intermediate portion of said elastic band attached to a movable slide member within said bar member to provide a resistive force against movement of said movable one of said side members which is mounted on said slide member for movement therewith in either opposite direction of movement; whereby the exercise device is locatable over a person's legs so that said side members engage the legs respectively by an amount to allow the upper calf portions of the legs and knees to be firmly located against said side members either inwardly or outwardly thereof without attaching said side members to the operator's legs for exerting pressure on said side members to move one side member relative to the other along said slot to exercise with a positive and negative resistance the adductor and abductor muscles by inward or outward movement of said user's legs and to allow immediate disengagement of the device from said user's legs as desired.

18. A device according to claim 17, in which said side members are detachable from said bar member and placeable against said bar member when not in use for storing, packing and shipping, and wherein interlocking means are provided to lock said side members in a position extending outwardly of said bar member.

19. A device according to claim 17, wherein indicator means are mounted on said bar member for displaying the degree of movement of said movable side member in relation to the other.

20. A device according to claim 19, wherein said indicator means comprises an electronic measuring device with a digital display.

21. A strapless exercise device adapted for simultaneously exercising with positive and negative resistance the adductor and abductor muscles of a person's legs comprising an elongate bar member having a hollow base portion with an elongate slot in an undersurface thereof, a lid portion for covering said base portion, two side members, one end of each side member being arranged to extend in use laterally to an elongate axis of said bar member, said side members including moulded padding means for inner and outer surfaces of said side members, said side members being short relative to the length of said bar member and extending freely from said bar member in a common direction substantially at right angles to said bar member, said side members in the natural condition of the exercise device being located inwardly of the ends of the said bar member, and resilient force resistive means mounted in said base portion of said bar member for resisting movement of a movable side member in either longitudinal direction along said slot, whereby when said exercise device is located across the legs of a user said side members with their padding means extend over the knees or upper calf portions of the legs so that said legs can be firmly located against said padding means inwardly or outwardly of the exercise device without securement of the device to said user's legs and to allow immediate disengagement of the device from said user's legs, and whereby said force resistive means resists movement of said movable side member in either longitudinal direction along said slot and maintains user's legs in contact with said outer or inner padding means to simultaneously exercise with positive and negative resistance said adductor and abductor muscles in response to inward and outward movement of the user's legs.

22. An exercise device as claimed in claim 21, wherein a fixed one of said side members extends through a circular hole in the undersurface of said base portion to prevent movement of said fixed one of said side members in the elongate direction of said bar member.

23. An exercise device as claimed in claim 22, including a slidable block located within said bar member and having a plurality of upstanding bosses thereon for receiving in a selected one thereof an end of a side member therein.

24. An exercise device as claimed in claim 23, wherein interconnection between said slidable block and side member is via a threaded interconnection between the internal surface of the relevant boss and outer surface of an interconnecting part of said side member.

* * * * *